United States Patent [19]

Wang

[11] Patent Number: 4,509,792

[45] Date of Patent: Apr. 9, 1985

[54] VENTILATED SEAT

[76] Inventor: Yen-Hsiung Wang, Industrial District, Tai Nan City, Taiwan

[21] Appl. No.: 484,265

[22] Filed: Apr. 12, 1983

[51] Int. Cl.[3] ..... A47C 7/72

[52] U.S. Cl. ..... 297/180; 297/453; 297/462

[58] Field of Search ..... 297/180, 453, 462; 98/40 B, DIG. 11

[56] References Cited

U.S. PATENT DOCUMENTS

| | | | |
|---|---|---|---|
| 800,458 | 9/1905 | Martin | 297/453 |
| 2,144,631 | 1/1939 | Kurth | 98/40 B |
| 2,372,830 | 4/1945 | Honerkamp et al. | 98/40 B |
| 2,826,135 | 3/1958 | Benzick | 297/180 X |
| 2,829,635 | 4/1958 | Teller | 297/180 X |
| 3,137,523 | 6/1964 | Karner | 297/180 |
| 4,134,615 | 1/1979 | Jenkins | 297/180 |

FOREIGN PATENT DOCUMENTS

| | | | |
|---|---|---|---|
| 265435 | 5/1927 | Fed. Rep. of Germany | 297/180 |
| 429326 | 3/1911 | France | 297/180 |

*Primary Examiner*—James T. McCall

*Attorney, Agent, or Firm*—Browdy and Neimark

[57] ABSTRACT

A ventilation seat substantially includes a housing with a lateral wall having passages for air ventilation, a fan which is adapted to be driven by a motor and rotatably mounted in the housing, and a seat member mounted on the housing. By means of providing a plurality of holes at the seat member in communication with the inside of the housing, cool air reaches the thighs, hip, sides, back and front parts of a person on the seat.

7 Claims, 6 Drawing Figures

VENTILATED SEAT

BACKGROUND OF THE INVENTION

The present invention relates to a seat, and more particularly to a seat in which an electric fan is built.

As shown in FIG. 1, there is shown a known stool which has a ventilating effect. The stool comprises a housing which includes a base 10, a plurality of supporting rods 20 and guide vanes 30. A fan 60 is adapted to be driven by a motor 50 which is mounted at the center of the base 10. A truncated cone diverges upwardly to act as a seat member 40 and is mounted on the top of the rods 20 of the housing. The guide vanes 30 are separated into two sets of different mounting orientations as shown, for guiding the air into the housing from the lower vanes 302 and out the housing from the upper vanes 301. Such a stool proves to be particularly suitable for doctor's use when seeing a patient. The stool can keep him from the unpleasant odor diffused from the patient.

However, a person on such a stool does not feel sufficiently comfortable, because the waist and the hip have no circulating air around them. Therefore the overall cooling efficiency of the body is still undesirably low. Thus, a seat capable of transmitting the air to one's thighs, hip, sides, back and front parts to achieve a greater cooling affect is desirable.

SUMMARY OF THE INVENTION

According to the present invention, a seat has a housing including a lateral wall having passages for air ventilation and has a plurality of holes provided at a seat member in communication with the housing for passing more air therefrom. The circulating air is supplied by a fan driven by a motor which is mounted in the housing.

The top surface of the seat member can be preferably provided with a plurality of annular grooves, the bottom of which communicate with the hole. In addition, the seat member can be provided with arc-bores for passing more air.

Moreover, the seat can further comprise a back which is a hollow member and has a plurality of holes at the front side thereof to transmit the air therefrom.

It is therefore an object of the present invention, to provide a seat which has a greater ventilation effect.

These and other advantages of the present invention may best be understood with reference to the drawings, in which:

BRIEF DESCRIPTION OF THE DRAWINGS

FIG. 4 is a sectional view of the second preferred embodiment of a ventilation seat.

FIG. 5 is a top view of the second preferred embodiment of a ventilation seat.

FIG. 6 is a sectional view of a third preferred embodiment illustrating the structure of a back of a ventilation seat.

DETAILED DESCRIPTION OF THE PREFERRED EMBODIMENT

Figure 1:
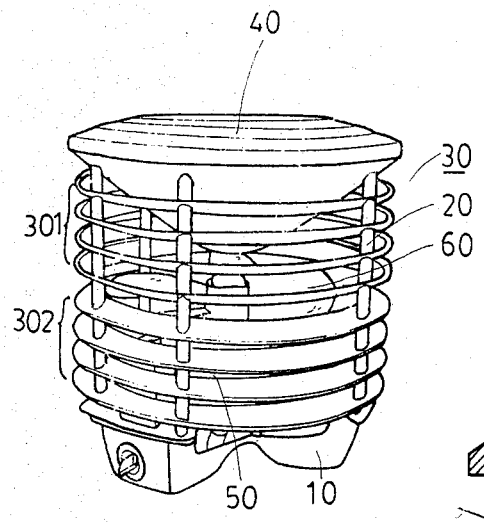
FIG. 1 PRIOR ART
FIG. 1 is a perspective view of a prior known stool which has a ventilating effect.
Figure 2:
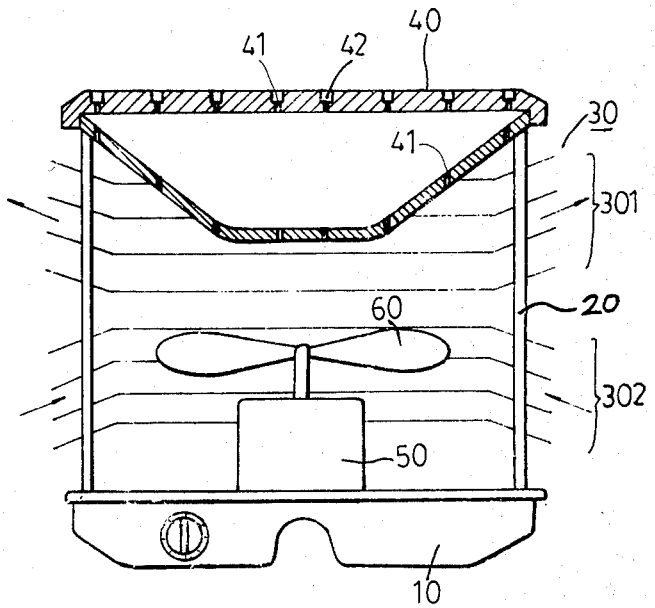
FIG. 2 is a sectional view of the first preferred embodiment of a ventilation seat of the present invention.
Figure 3:
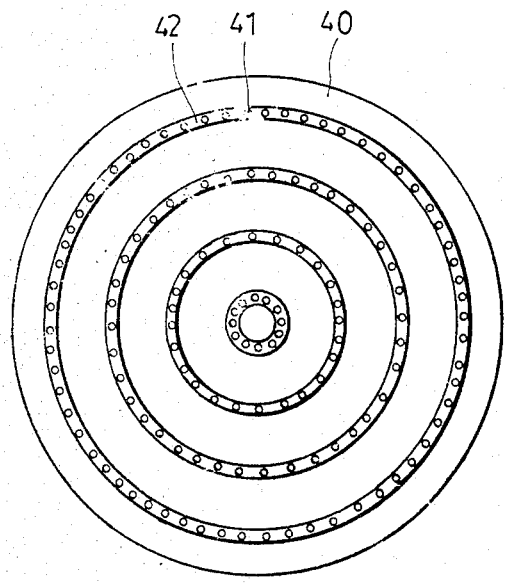
FIG. 3 is a top view of the first preferred embodiment of a ventilation seat.

Referring now to the first preferred embodiment, as shown in FIG. 2, the ventilation seat comprises a housing which has a base 10, supporting rods 20, guide vanes 30, a motor 50 and a fan 60 as described in the prior art. As seen from FIGS. 2 and 3, the seat member 40 is provided with a plurality of through holes 41. The air blown up by the fan 60 will have two ways to pass. One path goes along the inclined edge of the seat member 40, which is a truncated cone diverging upwardly, and passess through the passages between every two adjacent vanes of the upper vanes 301. The air also passes through the holes 41 which thus form the other path for air to pass. At the top surface of the seat member 40, there are a plurality of annular grooves 42 which prevent one's thighs and hip from blocking the up-passing air and are in communication with the holes at the bottom.

A second preferred embodiment of the present invention, as shown in FIGS. 4 and 5, the seat member 40 which is shaped into a flat piece, still is provided a plurality of holes 41 and annular grooves 42. Arc-bores 43 are provided for passing more upward air and preferably cooling one's body. The upper vanes 301 are gradually downwardly narrower in breadth to further concentrate the upward air flow.

An another preferred embodiment of the present invention of a ventilation seat which is further provided with a back 80 which is a hollow member and communicates with the inside of the housing through arc-bore 43. The back 80 is formed into a shape to match one's back and is provided with a plurality of holes 81 to transmit the air therefrom. Under such a structure, a vane and a circular thin plate 70 which is usually broader than the vanes 30, are employed instead of the upper vanes so as to gather more upwardly passing air. In addition, to prevent the backward displacement of the center of gravity of the seat when one leans against the back 80 to overturn the seat, the base 10 should be expanded accordingly.

While the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which are to be accorded the broadest interpretation so as to encompass all such modifications and equivalent structures.

What I claim is:

1. A ventilated seat substantially comprising: a housing including a lateral wall having passages extending therethrough for air ventilation;

a fan rotatably mounted in said housing and being adapted to be driven by a motor; and a seat member mounted on said housing and having a top surface;

wherein the top surface of said seat member is provided with a plurality of holes which communicate with the inside of said housing, and the top surface of said seat member is provided with a plurality of annular grooves, and said holes communicate with the bottom of said grooves.

2. A ventilation seat according to claim 1, wherein said seat member is a truncated cone which diverges upwardly.

3. A ventilation seat according to claim 1, wherein said seat member is a flat piece.

4. A ventilation seat according to claim 3, wherein said seat member further provides a plurality of arc-bores for passing more air.

5. A ventilation seat according to claim 3, wherein said lateral wall has a plurality of upper annular vanes for guiding the air out of said housing and a plurality of lower vanes for guiding the air into said housing, characterized in that said upper vanes are gradually downwardly narrower in breadth.

6. A ventilated seat according to claim 1, further comprising a back, said back being a hollow member which communicates with the inside of said housing and has a plurality of holes at the front side thereof to transmit the air therefrom.

7. A drafty seat according to claim 6, wherein the upper portion of the lateral wall has a vane and a circular thin plate which is broader than said vane.

* * * * *